United States Patent [19]

Conroy

[11] 4,373,844

[45] Feb. 15, 1983

[54] SEMIAUTOMATIC MACHINE FOR ASSEMBLING PAPER DUST JACKETS ON NEW HARD COVER BOOKS

[76] Inventor: John A. Conroy, 14833 Furman St., Forest Lake, Minn. 55025

[21] Appl. No.: 196,435

[22] Filed: Oct. 14, 1980

[51] Int. Cl.[3] ..... B24C 5/00

[52] U.S. Cl. ..... 412/24; 412/4

[58] Field of Search ..... 11/1 R, 4, 3

[56] References Cited

U.S. PATENT DOCUMENTS

| | | | |
|---|---|---|---|
| 2,570,916 | 10/1951 | Burls | 11/1 R |
| 3,706,107 | 12/1972 | Cullen | 11/1 R |
| 3,881,204 | 5/1975 | Sato | 11/1 R |
| 3,922,743 | 12/1975 | Schuler et al. | 11/1 R |
| 4,100,639 | 7/1978 | Dietrich | 11/1 R |

*Primary Examiner*—Paul A. Bell
*Assistant Examiner*—John S. Brown
*Attorney, Agent, or Firm*—John W. Adams

[57] ABSTRACT

This is a machine which assists the operator in assembling paper dust jackets around the hard covers of a new book. The machine includes the plurality of vacuum suction cups mounted on a pair of oscillating transferring arms which transport the paper jacket from a supply stack to position the jacket on the back of a hard cover book while the book is being held in a positioning jig which also supports the covers in substantially horizontal position to receive the jacket from the vacuum cup and transfer arm assembly. The transfer arms are mounted on an oscillating shaft which is actuated by the positive air discharge from a compressor. A vacuum pump provides the vacuum for the suction cups. The chain and sprocket drive rotates the transfer arms and the suction cups from the plane of the pickup position to the plane defined by the book covers in the positioning jig during the transfer movement of the arms through their predetermined arc.

8 Claims, 4 Drawing Figures

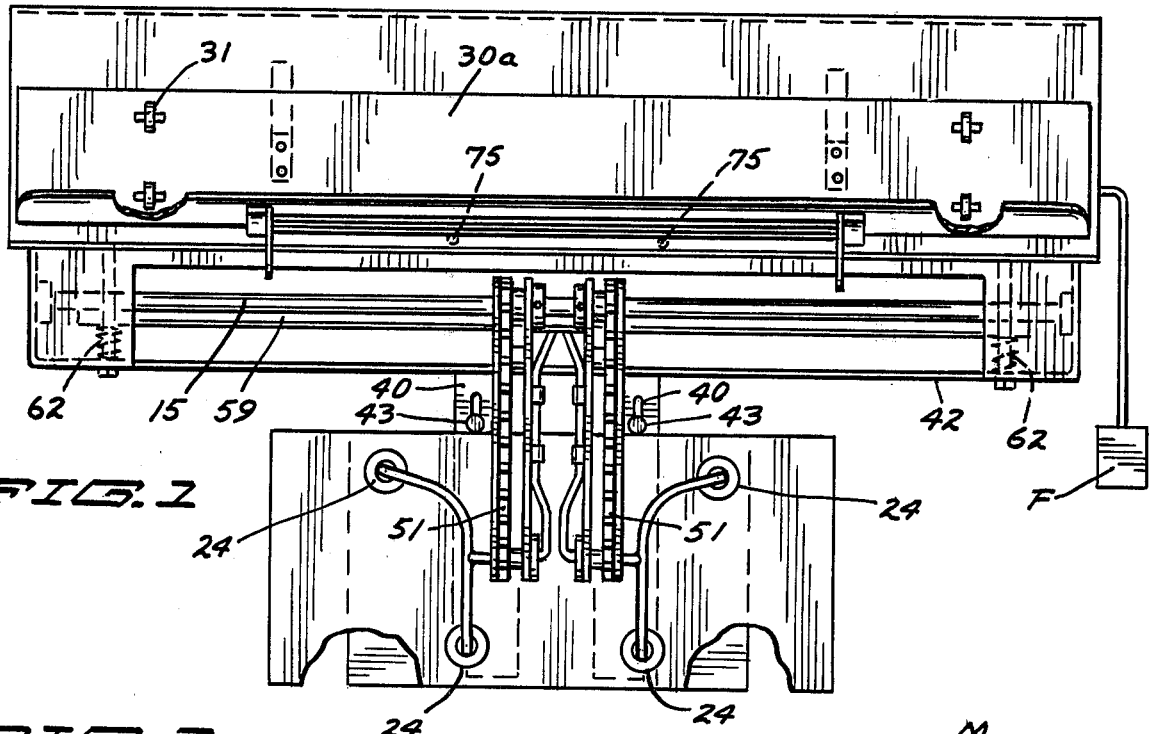
FIG. 1
FIG. 2
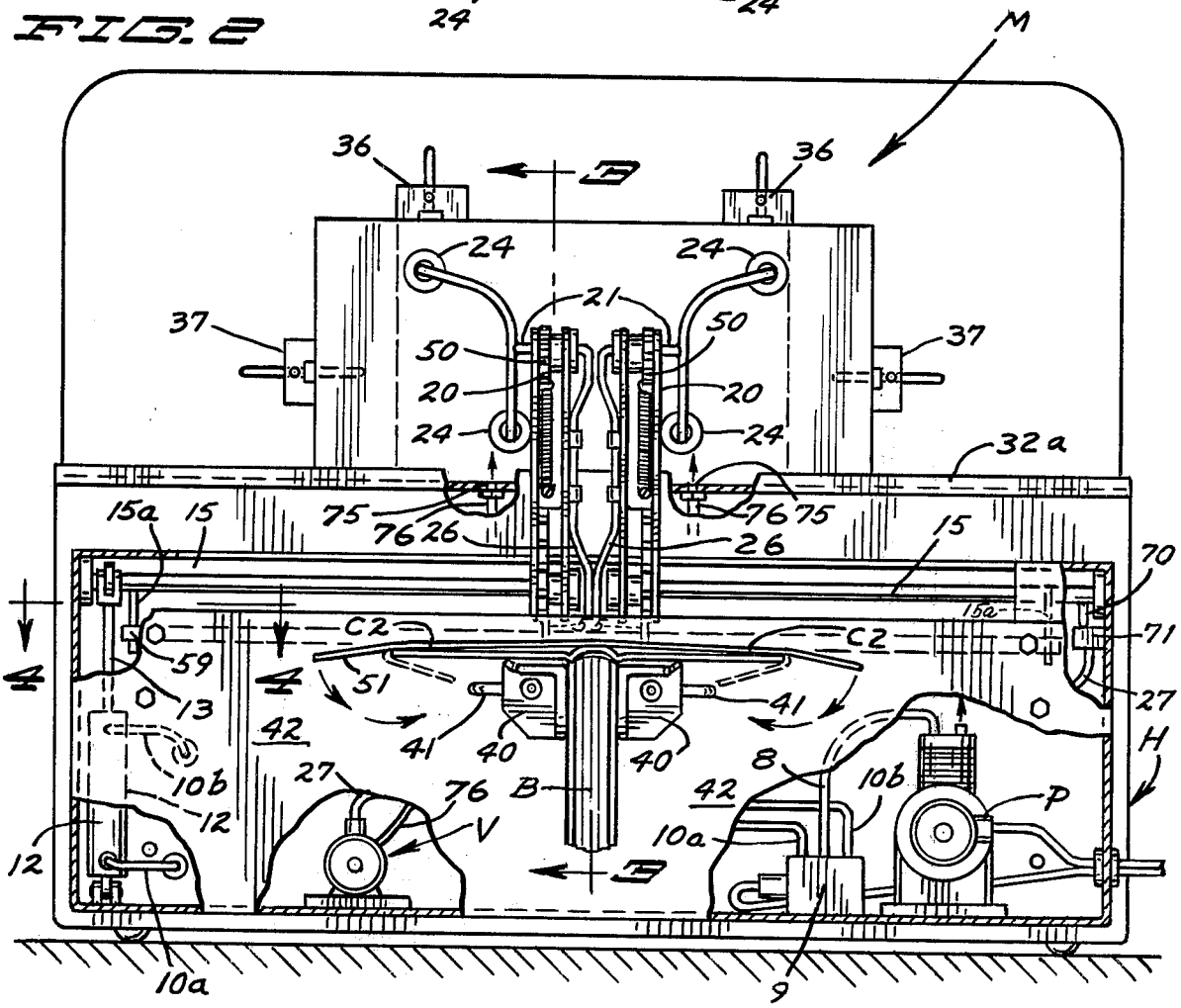

SEMIAUTOMATIC MACHINE FOR ASSEMBLING PAPER DUST JACKETS ON NEW HARD COVER BOOKS

BACKGROUND OF THE INVENTION

In the past, dust covers for jackets have been assembled on new books by a strictly hand operation. This is slow and tedious and extremely costly with the high present-day labor costs. Also very expensive automatic machines are available.

SUMMARY OF THE INVENTION

This invention provides a relatively simple and inexpensive yet highly efficient semiautomatic machine which will greatly assist an operator in assembling paper jackets on new books. The machine includes a plurality of vacuum suction cups mounted on a pair of spaced transfer arms, the spacing between which is adjustable, wherein the suction cups initially engage and grip the outside surface of a paper jacket to remove the jacket from an upstanding supply stack which, in form shown, is positioned on edge. The arms are mounted on an oscillating shaft which is rotated through the predetermined arc by means of an air cylinder which receives its air supply from the discharge of the pressure pump. The suction for the vacuum cups is provided by a vacuum pump. A chain and sprocket drive arrangement, mounted on said arms, rotates the transfer arms with the suction cups with the jacket attached thereto through slightly more than a 90 degree angle from the slightly laid back plane of the supply stack to the substantially horizontally disposed book covers held in jacket receiving position in a jig. This permits an operator to fold the wraparound edge portions of the paper dust cover around the two covers of the book, thus completing the assembly operation. The book with dust cover applied thereto is then manually removed from the jig and the process repeated.

The vertical relationship between the oscillating shaft and the supply stack of jackets can be varied for different size books. The book-holding jig consists of a pair of vertically adjustable supporting arms which provide a pair of co-planner flange elements for holding the book covers in co-planner horizontal jacket receiving position. The adjustment of the transfer arms on the shaft facilitates alignment of the jacket sheets with the book. Tests have established that the use of the machine doubles the production time for each operator and is adjustable for a wide variety of different size books with a quick and easy set-up procedure for the initial book size adjustment.

DESCRIPTION OF THE DRAWINGS

FIG. 1 is a top plan of the invention;

FIG. 2 is a front elevational view of the invention;

DETAILED DESCRIPTION OF THE PREFERRED EMBODIMENT

Figure 3:
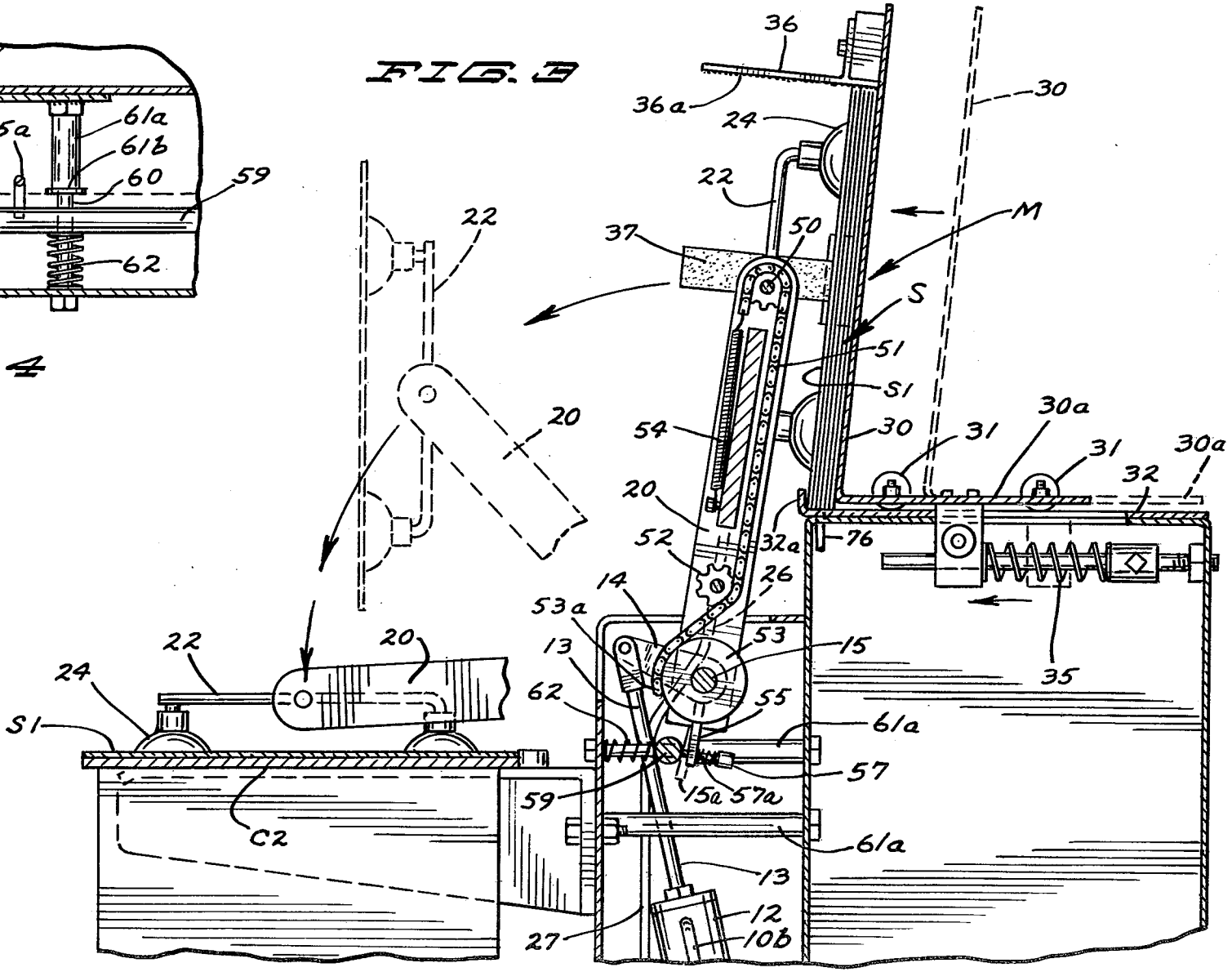
FIG. 3 is a vertical section taken substantially along the offset section line 3—3 of FIG. 2.
Figure 4:
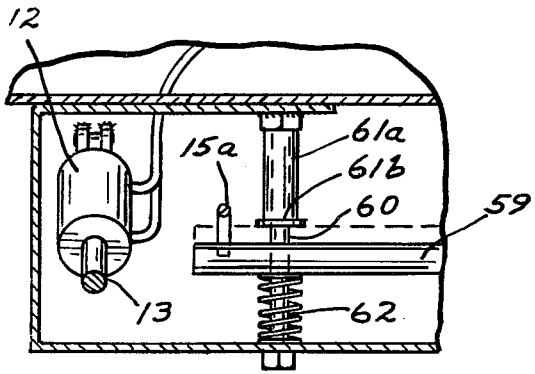
FIG. 4 is a fragmentary section taken substantially along the line 4—4 of FIG. 2.

The device illustrated includes a base housing H within which a conventional air compressor P is provided. A compressed air supply line 8 extends from the compressor P to a solenoid valve 9. A pair of supply conduits 10*a* and 10*b* are respectively connected at the opposite ends of the valve 9 and extend to opposite ends of a double acting air cylinder 12. The piston (not shown) within the cylinder 12 is connected to piston rod 13 which actuates an oscillating arm 14 fixed to an actuating shaft 15.

A pair of carrier arms 22 are journalled for rotation in the outer end portions of the transfer arms 20. The carrier arms 22 are hollow and have vacuum cups 24 connected to the ends thereof with suitable apertures communicating with the hollow suction passage formed within the arms 22. The shafts 21 to which the arms 22 are fixed are also hollow and are connected to vacuum supply lines 26 which in turn are connected to a vacuum pump V by a suitable conduit 27.

A supply magazine M is provided on the backside of the base housing H and has a backing member 30 with a rearwardly extending flange 30*a* which is mounted on rollers 31 supported on a suitable platform 32 of the housing H. Platform 32 extends forwardly to form the support for a stack of paper dust jackets S and the platform has a retaining lip 32*a* along the forward edge thereof. A pair of compression springs 35 urge the backing plate forwardly as best shown in FIG. 3. A pair of upper retaining flanges 36 have frictional pads 36*a* on the bottom surfaces thereof to engage the upper edges of the dust jackets in the stack S and hold the same in place. A pair of side flanges 37 are also provided for maintaining the upstanding edges of the stack in the desired alignment. Both the flanges 36 and 37 are adjustable for accommodating dust covers of varying sizes. As the stack diminishes in thickness the plate 30 will move from its dotted position shown in FIG. 3 to its full line position also shown in FIG. 3.

A jig for holding the book B in cover receiving position is formed by a pair of forwardly extended arms 40 which are spaced apart with suitable adjusting means such as the clamping screws 40*a* adjustably mounted in slots 41 formed in the front mounting plate 42 of the housing H. Suitable stops 43 in the form of upstanding pins are adjustably mounted on the arms 40 and serve to positively position the covers C of the book B as best shown in FIGS. 1 and 2.

The hollow mounting shafts 21 are rotatably mounted in the end portions of the transfer arms 20 and each shaft has a sprocket wheel 50 fixed thereto. A chain 51 best shown in FIGS. 2 and 3 is meshed with the sprocket wheel 50 and travels around an idler sprocket 52 with one end fixed to a takeup wheel 53 as at location 53*a* shown in FIG. 3. The outer end of the chain 51 has a tensioning spring 54 connected therewith to produce the necessary travel of the chain 51 and cause the desired rotation of the sprockets 50 which in turn causes rotation of the carrier arms 22 when the transfer arms are swung from pickup position to discharge position as best shown in FIG. 3.

A foot pedal F is provided for actuating the valve 9 which controls the flow of compressed air to the double acting cylinder 12. When the foot pedal is released the arms 20 are in raised pickup position as shown in FIGS. 1, 2 and 3. When the foot pedal is depressed the valve 9 is actuated and the air flow into the cylinder 12 is through conduit 10*b* which causes the piston rod 13 to be retracted downwardly thus rotating the shaft 15 in a counter clockwise direction. This swings the arms 20 through an arc of slightly more than 90 degrees (between approximately 100 degrees and 110 degrees in the form shown) during which time the chain will be unwrapped from the takeup wheel 53 and will be taken up by spring 54 to rotate a sprocket wheel 50 in a counter clockwise direction. This rotation of the sprocket wheel 50 is sufficient to cause the carrier arms 22 to be rotated from the pickup position through an arc of slightly more than 280 degrees into discharge position as best shown in FIG. 3. The tension in spring 54 maintains contact between the screw pins 57 and the spring loaded crossbar 59. The spring loaded crossbar 59 is engaged by radially extending retracting pins 15*a* (fixed to shaft 15) when the arms 20 are in upwardly extending pickup position but the pins are released from crossbar 59 when the arms begin their downward arc into discharge position. The purpose of this mechanism will be subsequently described. When the arms 20 reach their discharge position with the book jacket S1 engaged against the top surface of the covers C1 and C2 of a book supported on the arms 40, an actuating arm 70 engages a vacuum release or bleeder valve 71 to break the vacuum in line 27 and cups 24 to release the jacket from the cups.

When the foot pedal F is released the valve 9 will be reversed and the flow of air to the air cylinder 12 will be through conduit 10*a* to reverse the piston and move the piston rod 13 upwardly and swing the arms 20 back into pickup position. As the arms 20 approach the jacket engaging position for the suction cups, the pins 15*a* will engage the spring loaded crossbar 59 to move the same forwardly against the springs 62 causing the arms 20 and 22 to move as a unit at substantially right angles to the plane of the stack of paper jackets S held in the magazine M. As best shown in FIG. 3, stop elements in the form of arms 55 are fixed to the respective take-up wheels 53 and have adjusting screw pins 57 (with openings 57*a*) mounted therethrough for engagement with stop bar 59.

A pair of air jets 75 are provided at the front of the magazine to insure separation of the front paper jacket S1 from the rest of the stack. These jets are connected to supply conduits 76 that are connected to the exhaust from the continuously driven vacuum pump V to supply a continuous flow of air to the jets 75. As the jackets are removed from the magazine and the stack S becomes smaller the spring 35 will move the backing plate 30 forwardly to maintain the front jacket engaged against the front retaining flange 32*a* as shown in FIG. 3.

It will be seen that I have provided a highly efficient semiautomatic device for assembling paper dust jackets one at a time onto the covers of a hard cover book thus materially speeding up the applying of the covers to the book. It has been found that the device will approximately double a hand operator's production and it should be pointed out that the device is easily adjustable for different size books.

What is claimed is:

1. A semiautomatic book jacket assembling machine comprising, a base structure, means for supporting a stack of paper book jackets in predetermined position on the base, means for positioning a book in predetermined position on the base with the two covers positively held in opened co-plannar, substantially horizontal relationship, gripping means for engaging and holding the outer jacket in the stack, power-actuated transfer means mounted on the base for removing the jackets one at a time from said supply stack and transferring the same to the cover of a book held by said positioning means in centered relationship on said book cover to permit an operator to fold the flap portions around the cover and complete the assembly operation, said jacket gripping means includes a plurality of suction cups, said transfer means includes a transfer arm assembly carrying said suction cups to move the jackets one at a time from stacked position to discharge position on said opened book cover, and also including means for rotating each jacket from the plane defined by the outer jacket of the supply stack to the plane defined by the opened book cover.

2. The structure set forth in claim 1 and at least one air nozzle positioned adjacent the front edge of the supply stack of jackets to direct a jet of air against the front edge of the stack and assist said gripping means in the separation of the front jacket from the rest of the jackets in the stack.

3. The structure set forth in claim 1 and said transfer means including a rotary shaft, a transfer arm assembly including at least one transfer arm fixed at one end to said shaft, carrier arms rotatably mounted on the outer end of said transfer arm, and means for rotating said shaft through an arc to transfer the jackets engaged by said suction cups, one at a time, from the supply stack to the book covers.

4. The structure set forth in claim 3 in said carrier arm rotating means including a chain and sprocket drive mechanism responsive for actuation to the rotation of said transfer arm and said shaft.

5. The structure set forth in claim 4 and said chain and sprocket drive mechanism including a sprocket wheel having driving connection with said carrier arms to rotate the same, a chain meshed with said sprocket wheel, an elongated tensioning spring connected at one end to one end of said chain and connected at its other end to said transfer arm, a take up wheel rotatably mounted on said shaft and having the other end of said chain fixed thereto, means for restricting the rotation of said take up wheel during swinging movement of said transfer arm to wrap or unwrap the end portion of the chain on said transfer wheel depending upon the direction of the swinging movement of said transfer arm.

6. The structure set forth in claim 5 and a pair of stop elements, one connected to said take up wheel and the other stop element mounted on the base and positioned so that the tension in said spring maintains contact between said stop elements to restrict rotation of said wheel, the stop element connected to said base being resiliently yieldable, an actuating member connected to said shaft for engaging said base mounted stop element to produce yielding movement thereof and effect an increment of rotation of said wheel coincident with the final increment of rotation of said shaft.

7. The structure set forth in claim 6 and the relationship between said two stop elements being adjustable to vary the position of the take up wheel and thus control the relationship of the carrier arms to the supply stack.

8. The structure set forth in claim 3, and said transfer arm assembly including a pair of transfer arms releasably fixed to said shaft to permit the spacing there between to be varied for different size jackets and books.

* * * * *